US005211140A

United States Patent [19]

Hironaka et al.

[11] Patent Number: 5,211,140

[45] Date of Patent: May 18, 1993

[54] DECOMPRESSOR FOR INTERNAL COMBUSTION ENGINE

[75] Inventors: Yoshiaki Hironaka, Sayama; Susumu Miyashita, Kodaira; Tadashige Kondo, Tokyo, all of Japan

[73] Assignee: Kioritz Corporation, Tokyo, Japan

[21] Appl. No.: 888,678

[22] Filed: May 27, 1992

[30] Foreign Application Priority Data

May 28, 1991 [JP] Japan ..... 3-038505[U]

[51] Int. Cl.[5] ..... F02B 77/08

[52] U.S. Cl. ..... 123/65 P; 123/182.1

[58] Field of Search ..... 123/182.1, 65 P, 65 R, 123/185.1, 185.2

[56] References Cited

U.S. PATENT DOCUMENTS 2,742,380 4/1956 Peters .
3,687,124 8/1972 Kolorz .
4,194,485 3/1980 Stephenson ..... 123/182.1
4,986,780 1/1991 Sougawa ..... 123/323
5,116,287 5/1992 Hironaka et al. ..... 123/182.1

FOREIGN PATENT DOCUMENTS 2-63109 12/1990 Japan .

*Primary Examiner*—David A. Okonsky
*Attorney, Agent, or Firm*—Browdy and Neimark

[57] ABSTRACT

A decompressor for an internal combustion engine including a mounting hole in which a decompression valve for opening and closing a pressure relief bore opening into a combustion chamber within a cylinder of the engine, is disposed, and also including a through-hole which is obliquely and rectilinearly formed through a portion of a wall of the cylinder, and through which an outer open end portion of the mounting hole is able to communicate with a scavenging passage of the engine.

1 Claim, 1 Drawing Sheet

DECOMPRESSOR FOR INTERNAL COMBUSTION ENGINE

BACKGROUND OF THE INVENTION

The present invention relates to a decompressor for an internal combustion engine.

Hitherto, a decompressor for an internal combustion engine has been known, which decompressor has a decompression valve disposed in a decompression passage through which an intake or exhaust passage of the internal combustion engine is able to communicate with a combustion chamber within a cylinder of the engine. At a starting of the internal combustion engine, the decompression valve is actuated in operational connection with, for instance, the movement of a movable member of a recoil starter so as to relieve pressure from the inside of the combustion chamber to the outside thereof. In this way, the resistance which a piston receives at a starting of the engine is reduced in order to facilitate the starting. However, such a conventional decompressor has a drawback in that the cylinder and peripheral equipment are contaminated with compressed air-fuel mixture being exhausted from the inside of the cylinder through the decompressor directly to the outside of the cylinder. Thus, the conventional decompressor fails to be readily applied to a type of internal combustion engine for a portable or carriable work machine.

SUMMARY OF THE INVENTION

An object of the present invention is to provide a decompressor for an internal combustion engine which is capable of eliminating the above-described drawback, and which has a simple and convenient configuration.

According to the present invention, there is provided a decompressor for an internal combustion engine, including: a mounting hole in which a decompression valve for opening and closing a pressure relief bore opening into a combustion chamber within a cylinder of the engine, is disposed; and a through-hole which is obliquely and rectilinearly formed through a portion of a wall of the cylinder, and through which an outer open end portion of the mounting hole is able to communicate with a scavenging passage of the engine.

With the above construction, the oblique and rectilinear through-hole which extends from the outer open end portion of the mounting hole to the scavenging passage can be easily formed by, for example, drilling with a drill applied from the outside of the cylinder. Thus, the decompressor has a simple structure, and can be readily made small. Since compressed gas being exhausted from the inside of the cylinder through the decompressor is relieved to the scavenging passage, it is possible to prevent contamination of the cylinder and peripheral equipment. Accordingly, the decompressor can be easily prepared, and can be advantageously used in an internal combustion engine for a portable or carriable work machine.

DESCRIPTION OF THE PREFERRED EMBODIMENT

Figure 1:
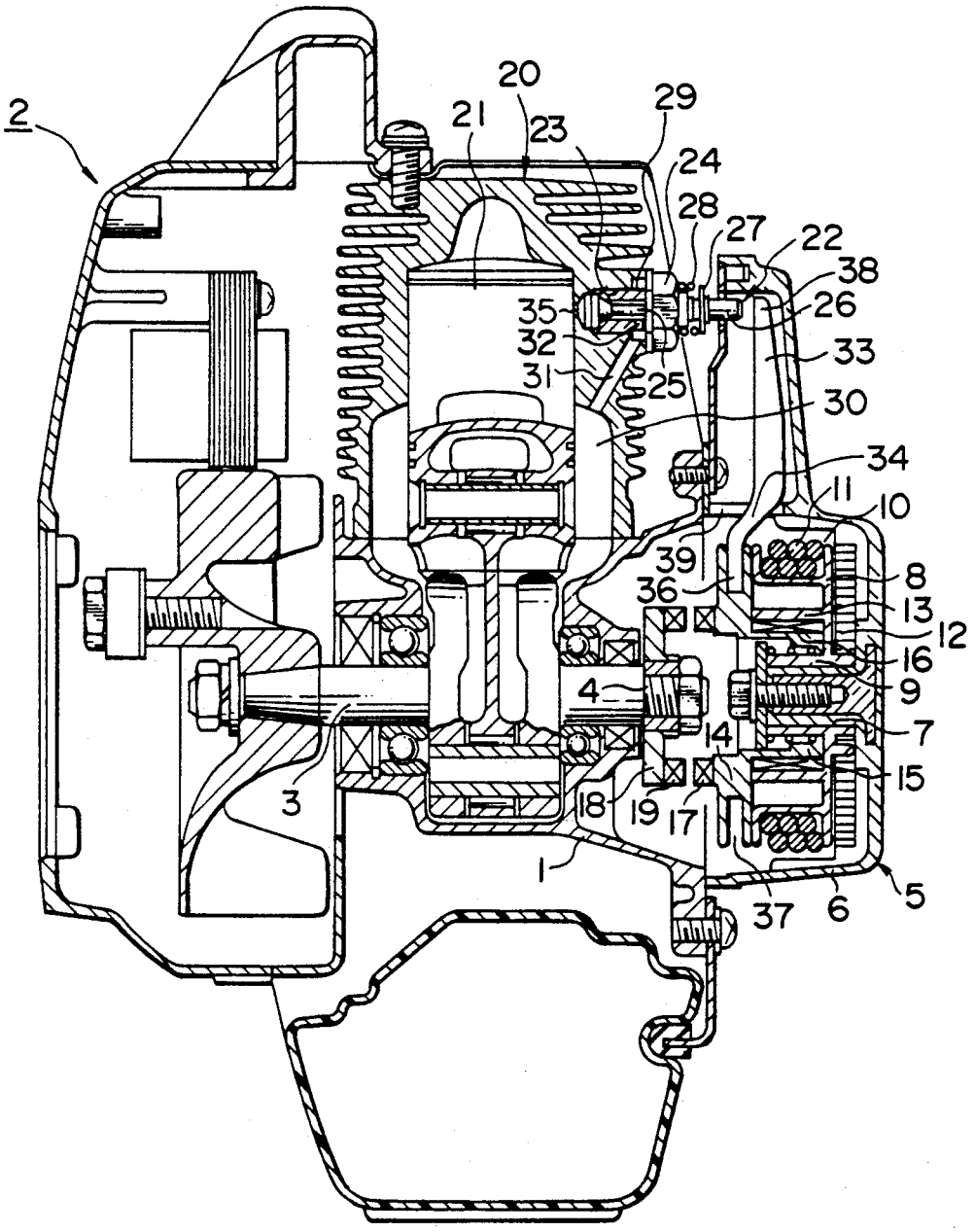
FIG. 1 shows a sectional view of the essential parts of an internal combustion engine having a decompressor for an internal combustion engine according to the present invention.

The present invention will now be described with reference to the accompanying drawing.

FIG. 1 is a side sectional view of an embodiment of the present invention. In this embodiment, the present invention is applied to an air-cooled two-cycle internal combustion engine which is of a relatively small size and which may be particularly used in a portable or carriable work machine such as a bush cutter.

Reference numeral 1 denotes a crankcase of an internal combustion engine 2. A Bendix-type recoil starter 5 is disposed close to a first end 4 of a crankshaft 3 of the engine 2. The starter 5 has a starter case 6 secured to the crankcase 1. The starter case 6 is formed integrally with an axial boss portion 7 disposed inside the starter case 6 and extending toward the first end 4 of the crankshaft 3. The axial boss portion 7 rotatably supports a hollow boss portion 9 of a recoil drum 8 so that the drum 8 is rotatable about the axial boss portion 7. The recoil drum 8 has a peripheral groove 10, in which a recoil rope 11 is coiled. The inner end of the recoil rope 11 is fixed to the recoil drum 8, and an outer end portion of the recoil rope 11 is extended to the outside of the starter case 6. The outer end of the recoil rope 11 carries a grip (not shown) attached thereto. A recoil spring 12 is provided in the space between an inner surface of the starter case 6 and the recoil drum 8, and has the ends thereof fixed to the starter case 6 and the recoil drum 8. The recoil spring 12 acts on the recoil drum 8 to urge it in the direction in which the the recoil rope 11 is wound on the drum 8. The recoil drum 8 has a cylindrical intermediate wall portion 13 integral therewith, the wall portion 13 opening toward the crankshaft 3. The outer peripheral surface of the boss portion 9 of the recoil drum 8 supports a hollow boss portion 15 of a driving pawl member 14 in such a manner as to allow the boss portion 15 to axially slide thereon. The boss portion 15 of the driving pawl member 14 has an outer peripheral surface which opposes the inner peripheral surface of the intermediate wall portion 13 of the recoil drum 8, and these mutually opposing surfaces have spiral splines meshing with each other to constitute a spiral spline joint 16. The above arrangement of the driving pawl member 14 is such that, when, at a starting of the engine, an outer end portion of the recoil rope 11 is pulled to the outside of the starter 5, the driving pawl member 14 moves toward the first end 4 of the crankshaft 3 (leftward, as viewed in FIG. 1). The driving pawl member 14 has a driving pawl 17 on the surface thereof which faces the first end 4 of the crankshaft 3. On the other hand, the first end 4 of the crankshaft 3 has a driven pawl member 18 fixed thereto. The driven pawl member 18 has a driven pawl 19 on the surface thereof which faces the driving pawl member 14, the driven pawl 19 being engageable with the driving pawl 17. The driving pawl member 14 is normally in the retracted position shown in FIG. 1, in which the driving pawl 17 is spaced away from the driven pawl 19 of the driven pawl member 18. When, however, the recoil rope 11 of the starter 5 is pulled for the purpose of starting the engine, the spline joint 16 operates to cause a movement of the driving pawl member 14 to its advanced position, which is a position leftward of the retracted position shown in FIG. 1, so that the driving pawl 17 comes into engagement with the driven pawl 19 of the driven pawl member 18.

The internal combustion engine 2 has a cylinder 20 with a space serving as a combustion chamber 21. A decompressor 22 is fixed to a position of the cylinder 20 which is above (as viewed in FIG. 1) the combustion chamber 21 and on the same side as the starter 5. The decompressor 22 includes a decompression valve 24 provided by screwing it into a mounting hole 23 formed horizontally through a portion of a wall of the cylinder 20. The decompression valve 24 has a valve body 25 for opening and closing a pressure relief bore 35 opening into the combustion chamber 21 within the cylinder 20. An outer end portion 26 of the valve body 25 is disposed inside the starter case 6. This outer end portion 26 is biased outward by a compression coil spring 28 disposed between another part of the decompression valve 24 and a flange member 27 fixed to a part of the outer end portion 26, whereby the valve body 25 is normally maintained in its position of closing the pressure relief bore 35.

The wall of the cylinder 20 is also formed with a pocket-shaped outer open end 29 of the mounting hole 23. The outer open end 29 is located at a position close to the outer surface of the wall of the cylinder 20, and has a greater inner diameter than the mounting hole 23 from which the outer open end 29 concentrically continues. Furthermore, a through-hole 31 is formed in the wall of the cylinder 20, the through-hole 31 extending rectilinearly and obliquely-downward from the bottom of the outer open end 29 through a side wall portion of the cylinder 20, and opening into an upper edge portion of a scavenging passage 30 of the engine 2. The through-hole 31 can be easily formed in the following manner: when the formation of the cylinder 20 has been completed, the cutting end of a drill is applied from the outside of the cylinder 20 to the bottom of the outer open end 29 of the mounting hole 23 while being directed obliquely downward; and the side wall portion of the cylinder 20 is drilled obliquely downward from the bottom to a position at the upper edge of the scavenging passage 30. When the valve body 25 of the decompression valve 24 is pushed inward across the outer open end 29 and a communication hole 32 formed in the decompression valve 24, and the pressure relief bore 35 is thus opened, the interior of the combustion chamber 21 is brought into communication with the scavenging passage 30.

When the scavenging passage 30 is of the socalled wall-less type, as shown in FIG. 1, the throughhole 31 may be formed by applying the cutting end of a drill from the side of a lower-end opening of the cylinder 20 to the upper edge of the scavenging passage 30.

The decompressor 22 further includes a decompressor actuating rod 33. The decompressor actuating rod 33 is disposed inside the starter case 6, and has an intermediate portion 34 at which the rod 33 is slidably supported by a slit-shaped guide portion 39 on an inner surface of the starter case 6. The decompressor actuating rod 33 has a base end portion 36, which is bifurcated in a substantially semi-circular shape, and which is received in a peripheral groove 37 formed in the driving pawl member 14 of the starter 5 while being held by the driving pawl member 14 with an appropriate, weak clamping force. A distal end portion 38 of the decompressor actuating rod 33 is disposed close to the outer end portion 26 of the valve body 25 of the decompression valve 24. When the driving pawl member 14 of the starter 5 is in the retracted position shown in FIG. 1, the distal end portion 38 of the decompressor actuating rod 33 is slightly spaced away from the outer end portion 26 of the valve body 25. At a starting of the engine, when the driving pawl member 14 of the starter 5 is moving leftward toward its advanced position, the distal end portion 38 of the decompressor actuating rod 33 is moved in unison with the driving pawl member 14 while being prevented from swinging by the guide portion 39 of the starter case 6 until the distal end portion 38 abuts against the outer end portion 26 of the valve body 25 of the decompression valve 24. This abutting causes the valve body 25 to move leftward against the force of the spring 28, so that the pressure relief bore 35 at a wall portion of the cylinder 20 is opened. When the combustion chamber 21 within the cylinder 20 is thus brought into communication with the scavenging passage 30 through the communication hole 32, the outer open end 29 of the mounting hole 23, and the through-hole 31, a part of the compressed mixture within the combustion chamber 21 of the cylinder 20 is relieved therefrom to the scavenging passage 30. In this way, the operation of starting the engine is facilitated while preventing contamination of the cylinder 20 and peripheral equipment.

The decompressor actuating rod 33 is able to positively advance and retract while being guided by the guide portion 39. Since the rod 33 provides an appropriate restriction to the rotation of the driving pawl member 14, the rod 33 serves to secure reliable operation of the Bendix-type recoil starter 5.

What is claimed is:

1. A decompressor for an internal combustion engine, including: a mounting hole, a decompression valve mounted in said hole for opening and closing a pressure relief bore, said bore opening into a combustion chamber within a cylinder of said engine; an outer open end portion concentrically continuing from said mounting hole and having a grater inner diameter than said mounting hole; and a through-hole which is obliquely and rectilinearly formed through a portion of a wall of said cylinder, and through which a pocket formed between said decompression valve and said outer open end portion is able to communicate with a scavenging passage of said engine.

* * * * *